US009252545B2

(12) United States Patent
Leibold et al.

(10) Patent No.: US 9,252,545 B2
(45) Date of Patent: Feb. 2, 2016

(54) ELECTRICAL CONNECTOR HAVING ELECTRICAL CONTACTS CONFIGURED TO REDUCE WEAR CAUSED BY WIPING

(71) Applicant: Tyco Electronics Corporation, Berwyn, PA (US)

(72) Inventors: Kevin Ray Leibold, New Cumberland, PA (US); Justin Shane McClellan, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/321,395

(22) Filed: Jul. 1, 2014

(65) Prior Publication Data

US 2016/0006191 A1 Jan. 7, 2016

(51) Int. Cl.

| | |
|---|---|
| ***H01R 24/20*** | (2011.01) |
| ***H01R 9/24*** | (2006.01) |
| *H01R 107/00* | (2006.01) |

(52) U.S. Cl.

CPC ..... *H01R 24/20* (2013.01); *H01R 9/2491* (2013.01); *H01R 2107/00* (2013.01)

(58) Field of Classification Search

CPC .... H01R 23/725; H01R 23/688; H01R 9/091; H01R 13/65807

See application file for complete search history.

(56) References Cited

U.S. PATENT DOCUMENTS

| | | | | |
|---|---|---|---|---|
| 4,035,047 | A * | 7/1977 | Ammon | 439/78 |
| 4,753,602 | A * | 6/1988 | Peyrat et al. | 439/78 |
| 5,443,398 | A * | 8/1995 | Ortega | 439/378 |
| 5,980,271 | A * | 11/1999 | MacDougall et al. | 439/78 |
| 6,312,296 | B1 * | 11/2001 | Jones | 439/751 |
| 6,540,559 | B1 * | 4/2003 | Kemmick et al. | 439/607.05 |
| 6,899,566 | B2 * | 5/2005 | Kline et al. | 439/607.56 |
| 7,488,219 | B2 * | 2/2009 | Matsumura | 439/751 |
| 2013/0344743 | A1 * | 12/2013 | De Bruijn et al. | 439/626 |

* cited by examiner

*Primary Examiner* — Gary Paumen

(57) ABSTRACT

Electrical connector including a contact array of electrical contacts. Each of the electrical contacts has an elongated body that extends along a central axis and an exterior surface that includes a wipe track. The wipe track extends along the central axis and is configured to engage a flexible contact finger of the mating connector. Each of the elongated bodies includes a forward segment, a mating segment, and a ramp portion that extends between and joins the forward and mating segments. An elevation of the wipe track along the mating segment is greater than an elevation of the wipe track along the forward segment. An elevation of the wipe track along the ramp portion increases as the wipe track extends from the forward segment to the mating segment such that the ramp portion deflects the contact finger from a first deflected condition to a greater second deflected condition.

19 Claims, 7 Drawing Sheets

ELECTRICAL CONNECTOR HAVING ELECTRICAL CONTACTS CONFIGURED TO REDUCE WEAR CAUSED BY WIPING

BACKGROUND OF THE INVENTION

The subject matter herein relates generally to electrical connectors having electrical contacts that sustain wear during a mating operation with another electrical connector.

Electrical connectors are used to transmit data and/or power in various industries. The electrical connectors are often configured to repeatedly engage and disengage complementary electrical connectors. The process of mating the electrical connectors may be referred to as a mating operation. Each mating operation may cause a small amount of wear to the electrical connectors. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts mechanically engage and slide along the corresponding header contacts. The sliding engagement between the receptacle and header contacts may be referred to as wiping, because each receptacle contact wipes along an exterior surface of the corresponding header contact. Friction generated during the wiping may cause mechanical wear to the header contact. For instance, adhesion between the receptacle contact and the corresponding header contact may remove surface materials of the corresponding header contact as the receptacle contact wipes along the header contact. Mechanical wear reduces the lifetime operability of the header contacts and/or header connector.

For at least some known backplane communication systems, each header contact is a single projection, such as a post or pin, and each receptacle contact may have a pair of contact fingers. The contact fingers have mating interfaces that face each other with a contact-receiving gap therebetween. During the mating operation, the header contact is received within the contact-receiving gap. The mating interfaces of the receptacle contact engage opposite sides of the header contact and are deflected away from each other.

When the contact fingers are in deflected condition, each of the contact fingers provides a normal force that presses the corresponding mating interface against the header contact. To maintain the electrical connection between the header contact and the corresponding contact fingers, larger normal forces may be desirable. However, larger normal forces may increase adhesive wear and, consequently, the amount of mechanical wear sustained by the header contact. In addition to reducing the lifetime operability of the header contact and/or header connector, excessive wear may negatively affect electrical performance.

Accordingly, a need remains for electrical contacts and electrical connectors having the same in which the electrical contacts sustain less mechanical wear during mating operations.

BRIEF DESCRIPTION OF THE INVENTION

In an embodiment, an electrical connector is provided that includes a connector housing configured to engage a mating connector during a mating operation. The electrical connector also includes a contact array having electrical contacts coupled to the connector housing. Each of the electrical contacts includes an elongated body that extends along a central axis and has an exterior surface that is configured to engage a contact finger of the mating connector along a wipe track. The wipe track extends along the central axis and has an elevation relative to the central axis. Each of the elongated bodies includes a forward segment, a mating segment, and a ramp portion that extends between and joins the forward and mating segments. The elevation of the wipe track along the mating segment is greater than the elevation of the wipe track along the forward segment. The elevation of the wipe track along the ramp portion increases as the wipe track extends from the forward segment to the mating segment such that the ramp portion deflects the contact finger from a first deflected condition to a greater second deflected condition during the mating operation.

In an embodiment, a communication system is provided that includes a receptacle connector having a plurality of receptacle contacts and a header connector having a plurality of header contacts that are configured to engage corresponding receptacle contacts of the receptacle connector. Each of the header contacts has an elongated body that extends along a central axis. Each of the elongated bodies has a wipe track along an exterior surface of the corresponding elongated body that extends along the central axis. The receptacle contacts are configured to directly engage the corresponding header contacts along the corresponding wipe tracks during a mating operation between the receptacle and header connectors. The wipe tracks have non-linear paths such that the corresponding receptacle contacts flex from first deflected conditions to second deflected conditions during the mating operation. Each of the receptacle contacts is in the second deflected condition when the receptacle and header connectors are fully mated. The receptacle contacts each apply first and second normal forces against the corresponding header contact when in the first and second deflected conditions, respectively. The second normal force is greater than the first normal force.

In an embodiment, an electrical contact is provided that includes an elongated body that extends along a central axis and has an exterior surface that includes a wipe track. The wipe track extends generally parallel to the central axis and is configured to engage a flexible contact finger of a mating connector. The wipe track has an elevation relative to the central axis. The elongated body includes a forward segment, a mating segment, and a ramp portion that extends between and joins the forward and mating segments. The elevation of the wipe track along the mating segment is greater than the elevation of the wipe track along the forward segment. The elevation of the wipe track along the ramp portion increases as the wipe track extends from the forward segment to the mating segment such that the ramp portion deflects the contact finger from a first deflected condition to a greater second deflected condition as the contact finger slides along the exterior surface in a mating direction that is parallel to the central axis.

DETAILED DESCRIPTION OF THE INVENTION

Embodiments set forth herein may include electrical contacts, electrical connectors having the electrical contacts, and communication systems having the electrical connectors. Embodiments may be configured to reduce wear and/or increase durability compared other known contacts, connectors, or systems. Although the illustrated embodiment includes electrical connectors that are used in high-speed communication systems, such as backplane or midplane communication systems, it should be understood that embodiments may be used in other communication systems or in other systems/devices that utilize electrical connectors. Accordingly, the inventive subject matter is not limited to the illustrated embodiment.

In order to distinguish similar elements in the detailed description and claims, various labels may be used. For example, an electrical connector may be referred to as a header connector, a receptacle connector, or a mating connector. Electrical contacts may be referred to as header contacts, receptacle contacts, or mating contacts. When similar elements are labeled differently (e.g., receptacle contacts and mating contacts), the different labels do not necessarily require structural differences. For instance, in some embodiments, the receptacle contacts described herein may be referred to as mating contacts.

Figure 1:
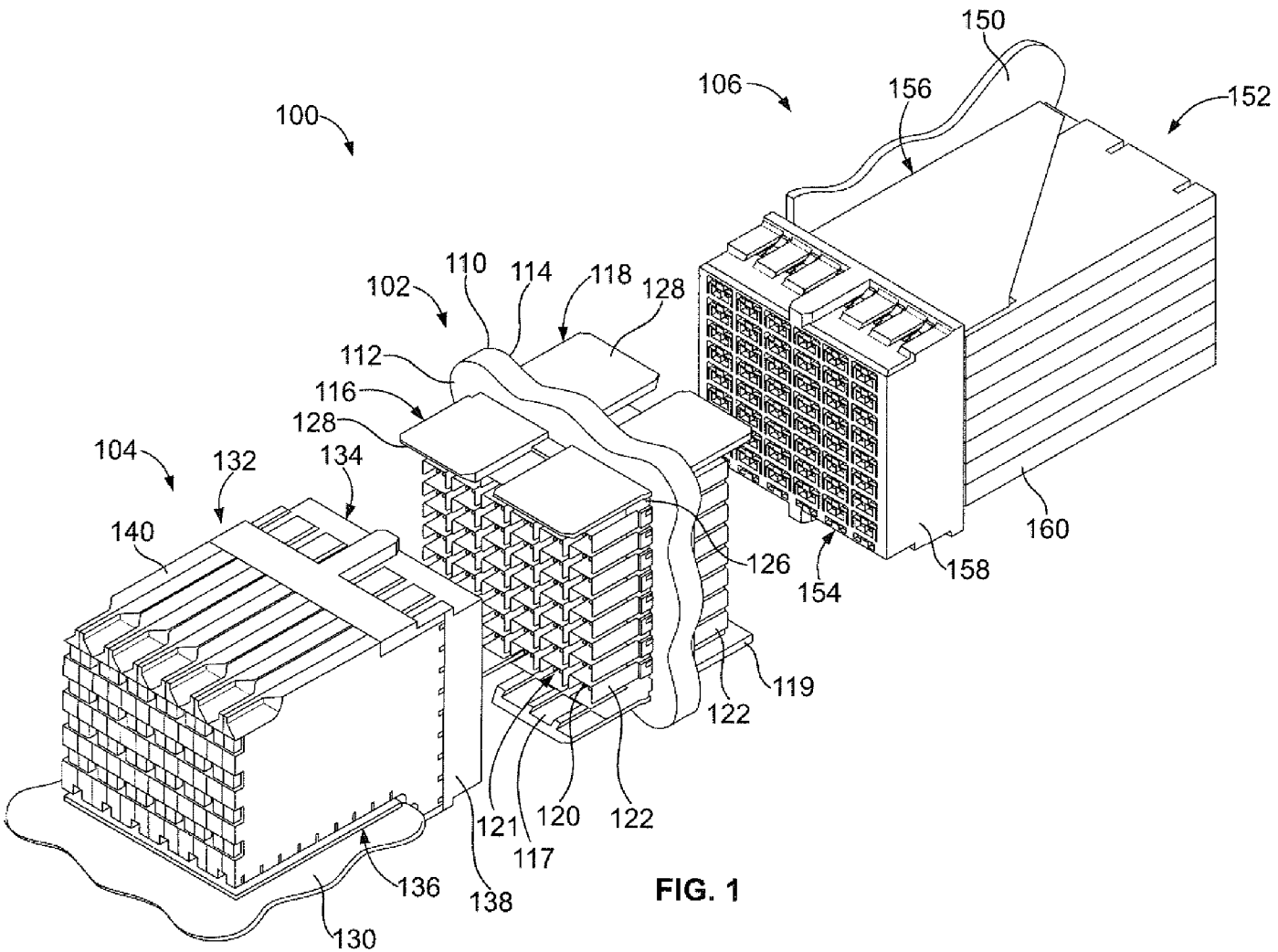
FIG. 1 is a front perspective view of a communication system formed in accordance with an embodiment.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, the first and second connector systems 104, 106 may be line cards or switch cards. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as a plastic material. Each of the connector housings 117, 119 includes a mounting wall 126 that is configured to be mounted to the circuit board 110 and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

The first receptacle connector 132 includes a front housing or shroud 138. The front housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (shown in FIGS. 3 and 4) that are electrically connected to the first circuit board 130. The electrical contacts 142 are hereinafter referred to as receptacle contacts 142. The receptacle contacts 142 are configured to be electrically connected to the header contacts 120 of the first header connector 116.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Figure 3:
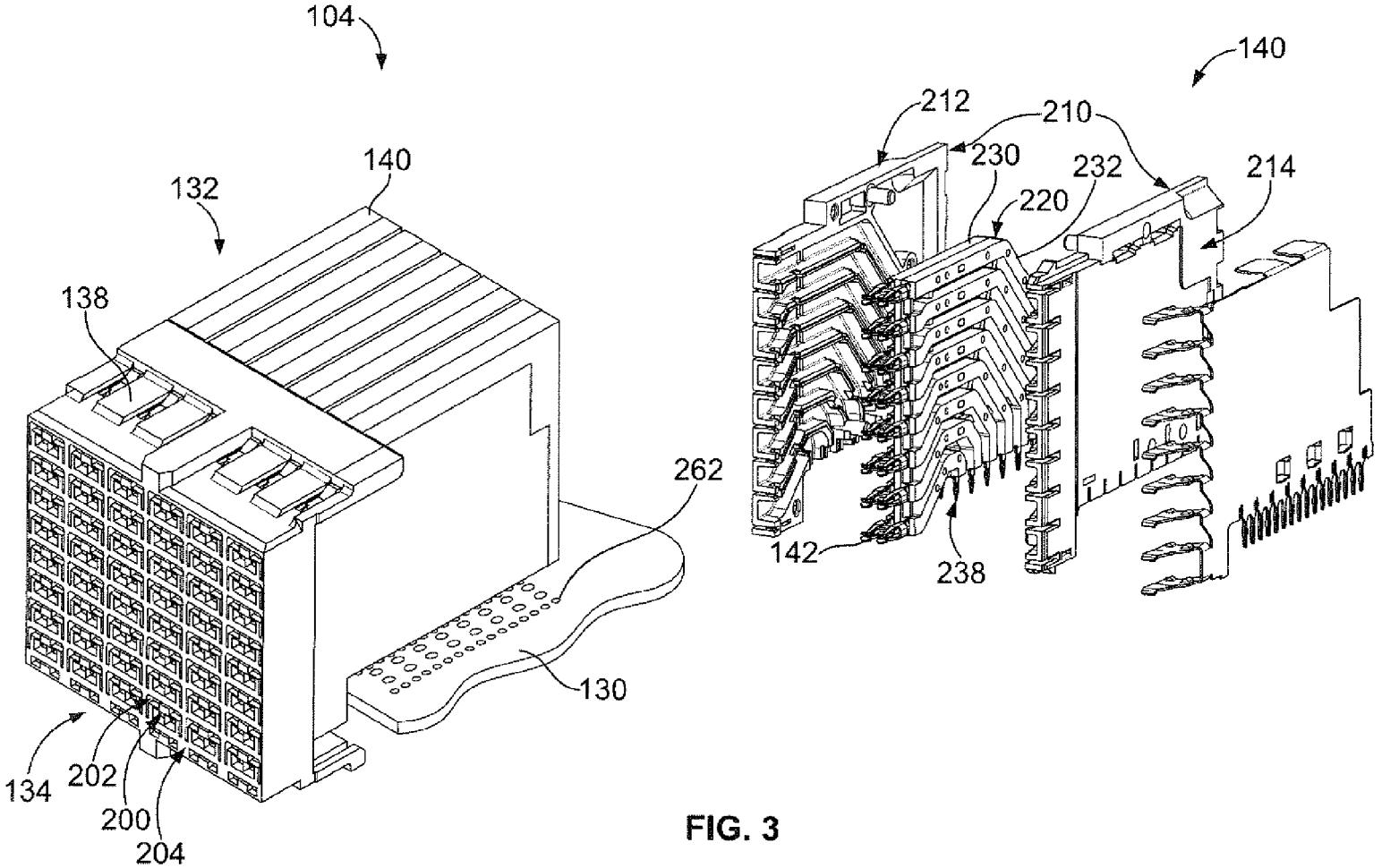
FIG. 3 is a perspective view of a receptacle connector that may be used with the communication system of FIG. 1.

Similar to the first receptacle connector 132, the second receptacle connector 152 includes a front housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Although not shown, in some embodiments, the communication system 100 may include a loading mechanism. The loading mechanism may include, for example, latches or levers that fully mate the corresponding receptacle and header connectors. For instance, the loading mechanism may be operably coupled to the receptacle connector 132 and, when actuated, drive the receptacle connector 132 into the header connector 116 to assure that the receptacle and header connectors 132, 116 are fully mated.

Figure 2:
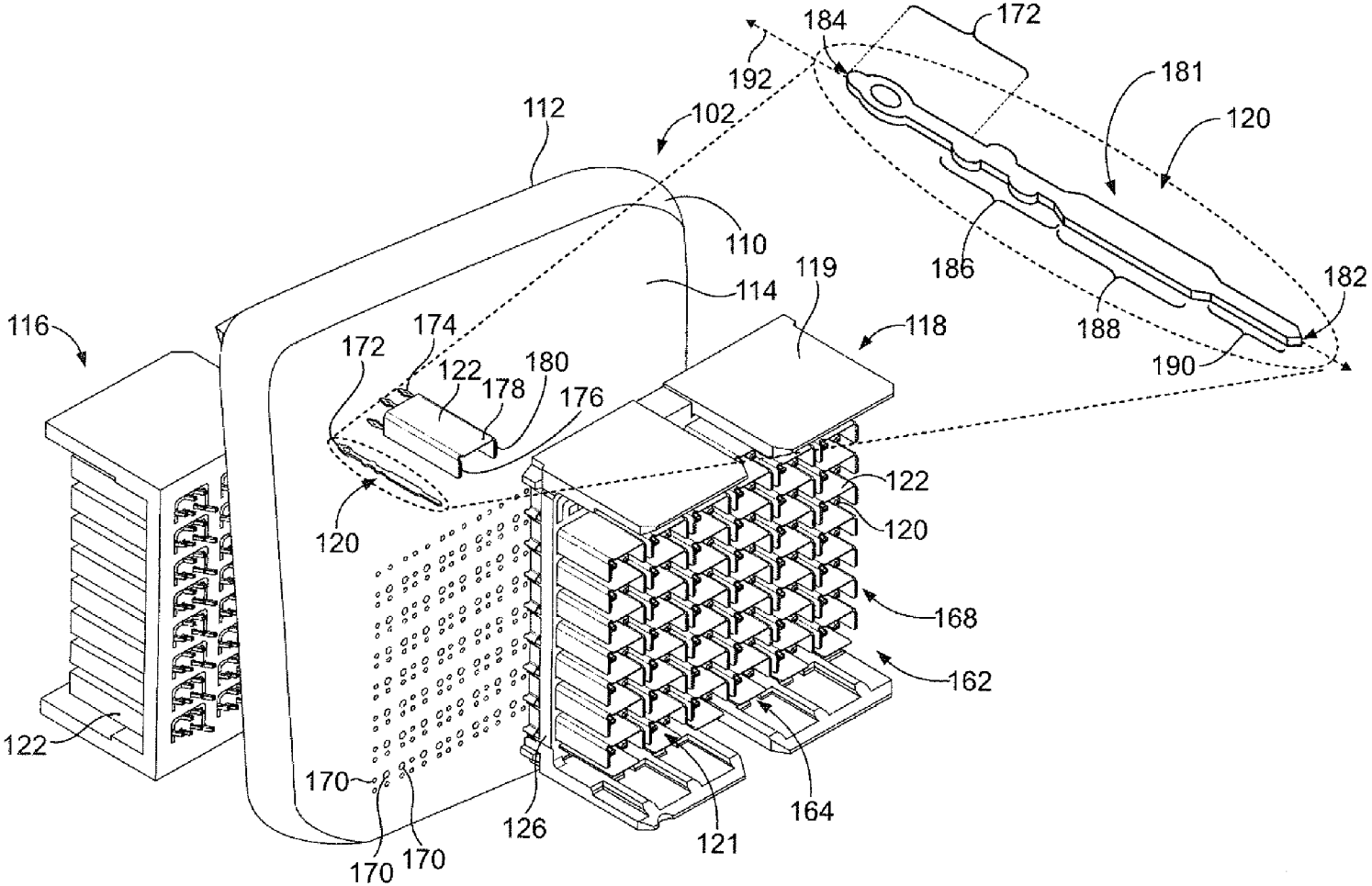
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a front end 162 that faces away from the second board side 114 of the circuit board 110. The connector housing 119 defines a housing cavity 164 that opens to the front end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, such as three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular with respect to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

An enlarged view of the header contact 120 is also shown in FIG. 2. The header contact 120 includes a distal end 182 and a board end 184. The board end 184 is configured to engage the circuit board 110. The distal end 182 may represent the portion of the header contact 120 that is located furthest from the circuit board 110 or the mounting wall 126 and is the first to engage or interface with the second receptacle connector 152 (FIG. 1). As shown, the header contact 120 has a central axis 192 extending therethrough between the board end 184 and the distal end 182. The central axis 192 may extend through an approximate center of the header contact 120.

The header contact 120 includes a plurality of axial elements or portions that are shaped differently with respect to one another and may have different functions. For example, the header contact 120 includes the compliant pin 172, a proximal base 186, a mating segment 188, and a forward segment 190. The compliant pin 172 includes the board end 184, and the forward segment 190 includes the distal end 182. As described above, the compliant pin 172 mechanically engages and electrically couples to a corresponding conductive via 170 of the circuit board 110. The proximal base 186 is sized and shaped to directly engage the mounting wall 126 of the connector housing 119. For example, the proximal base 186 may be inserted into a passage 320 (shown in FIG. 5) of the mounting wall 126 and engage the mounting wall 126 to form an interference fit therewith.

The header contact 120 also includes an elongated body 181 that may represent the portion of the header contact 120 that is exposed within the housing cavity 164. The elongated body 181 includes the mating and forward segments 188, 190. As described below, each of the mating and forward segments 188, 190 is configured to slidably engage one or more receptacle contacts 142 (shown in FIGS. 3 and 4) during the mating operation.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The front housing 138 includes a plurality of contact openings 200, 202 at a front end 204 of the front housing 138. The front end 204 defines the mating interface 134 of the first receptacle connector 132 that engages the first header connector 116 (FIG. 1).

The contact modules 140 are coupled to the front housing 138 such that the receptacle contacts 142 are received in corresponding contact openings 200. Optionally, a single receptacle contact 142 may be received in each contact opening 200. The contact openings 200 may be configured to receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The front housing 138 may be manufactured from a dielectric material, such as a plastic material, and may provide isolation between the contact openings 200 and the contact openings 202. The front housing 138 may isolate the receptacle contacts 142 and the header contacts 120 from the ground shields 122. In some embodiments, the contact module 140 includes a conductive holder 210. The conductive holder 210 may include a first holder member 212 and a second holder member 214 that are coupled together. The holder members 212, 214 may be fabricated from a conductive material. As such, the holder members 212, 214 may provide electrical shielding for the first receptacle connector 132. When the holder members 212, 214 are coupled together, the holder members 212, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through the signal conductor (not shown).

Figure 4:
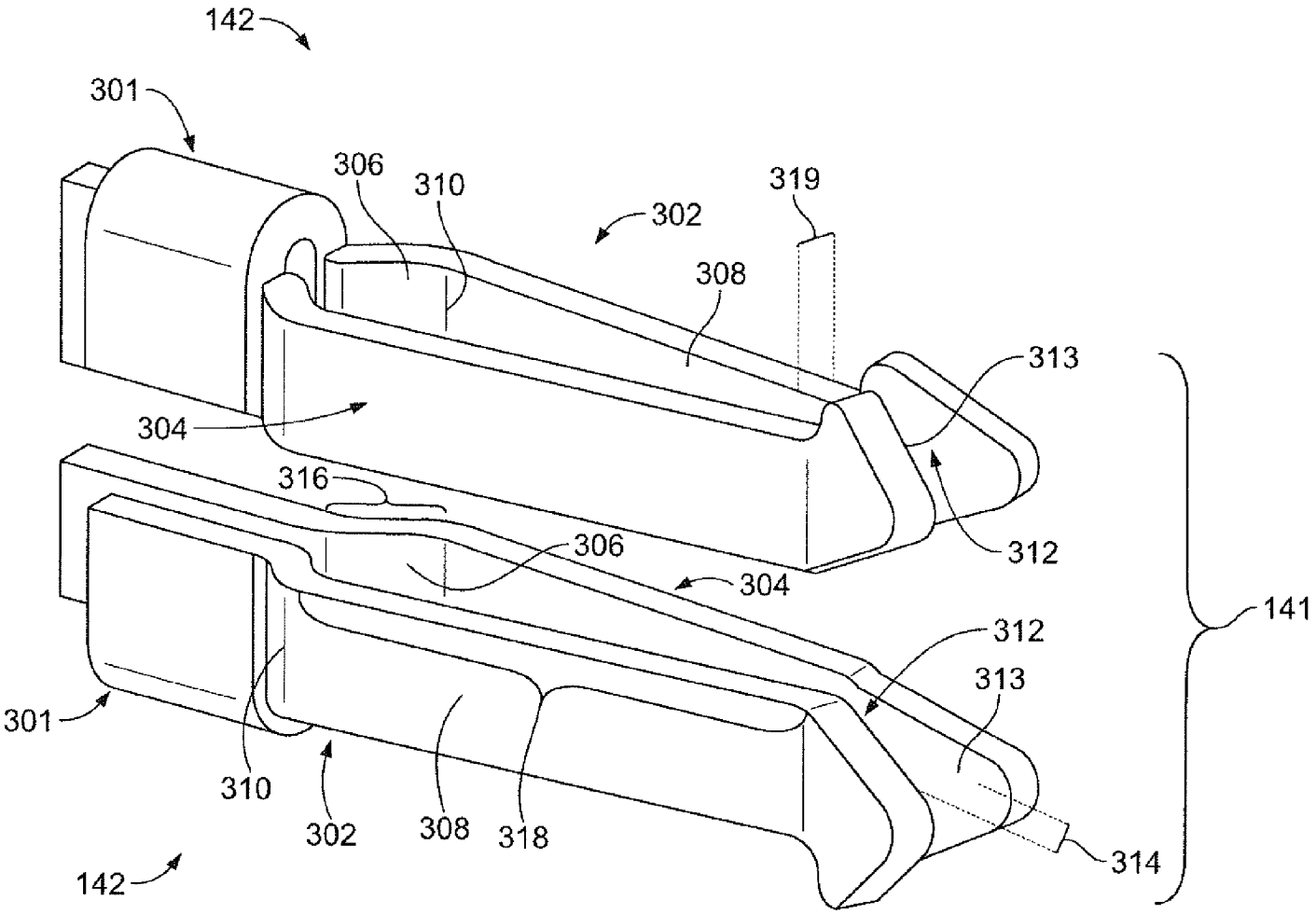
FIG. 4 is an isolated view of receptacle contacts that may be used with the receptacle connector of FIG. 3.

FIG. 4 is an isolated perspective view of a signal pair 141 of two receptacle contacts 142. Each of the receptacle contacts 142 of the signal pair 141 is configured to mechanically and electrical engage a corresponding header contact 120 (FIG. 1) of the same signal pair 121 (FIG. 1). Each of the receptacle contacts 142 may be stamped from a common sheet of material and be shaped to include a contact base 301 and a pair of elongated, flexible contact fingers 302, 304 that project from the corresponding contact base 301.

In the illustrated embodiment, the receptacle contacts 142 are identical. As such, the following description is applicable to each of the receptacle contacts 142. It should be understood, however, that the receptacle contacts 142 of the signal pair 141 are not required to be identical. It should also be understood that the receptacle contacts 142 of the corresponding receptacle connector are not required to be identical. For example, in some embodiments, the receptacle contacts may be configured differently so that the receptacle contacts electrically engage the corresponding header contacts at different times during the mating operation.

Each of the contact fingers 302, 304 includes a base portion 306, a beam portion 308, and a joint portion 310. The beam portions 308 extend to respective mating interfaces 312. The mating interfaces 312 of the contact fingers 302, 304 face each other with a contact-receiving gap 314 therebetween. In the illustrated embodiment, the corresponding mating interfaces 312 of the contact fingers 302, 304 are substantially paddle-shaped or tab-shaped. The mating interface 312 includes a flared portion 313 that extends away from the opposing mating interface 312 to enlarge the contact-receiving gap 314. The curved contour of the mating interfaces 312 and the flared portions 313 may facilitate receiving one of the header contacts 120 (FIG. 1) within the contact-receiving gap 314.

In FIG. 4, the contact fingers 302, 304 are in a relaxed condition or state. During a mating operation between, for example, the first header connector 116 (FIG. 1) and the first receptacle connector 132 (FIG. 1), each of the header contacts 120 (FIG. 1) is received within a contact-receiving gap 314 of a corresponding receptacle contact 142. The opposing mating interfaces 312 may engage opposite sides of the header contact 120. As the header contact 120 is advanced through the contact-receiving gap 314, the header contact 120 deflects the contact fingers 302, 304 away from each other.

As described in greater detail below, when the contact fingers 302, 304 are in deflected conditions, each of the contact fingers 302, 304 may generate a normal force that presses the corresponding mating interface 312 against the corresponding header contact 120 in a direction toward the other mating interface 312. As such, the contact fingers 302, 304 may pinch the corresponding header contact 120 therebetween. To this end, each of the contact fingers 302, 304 may be configured to provide a designated normal force when the corresponding contact finger is in a deflected condition. For example, the base portion 306 may have a designated length 316, the beam portion 308 may have a designated length 318, and the joint portion 310 may have a designated shape or contour. Each of the contact fingers 302, 304 may also have a designated thickness 319. In an exemplary embodiment, the thickness 319 is substantially uniform throughout the corresponding contact finger. The lengths 316, 318, the shape of the joint portion 310, and the thickness 319 may be configured such that each of the contact fingers 302, 304 provides a designated normal force against the header contact 120. The lengths 316, 318 and the shape of the joint portion 310 may also be configured to locate the mating interface 312 at a designated location along the header contact 120 (FIG. 1).

Figure 5:
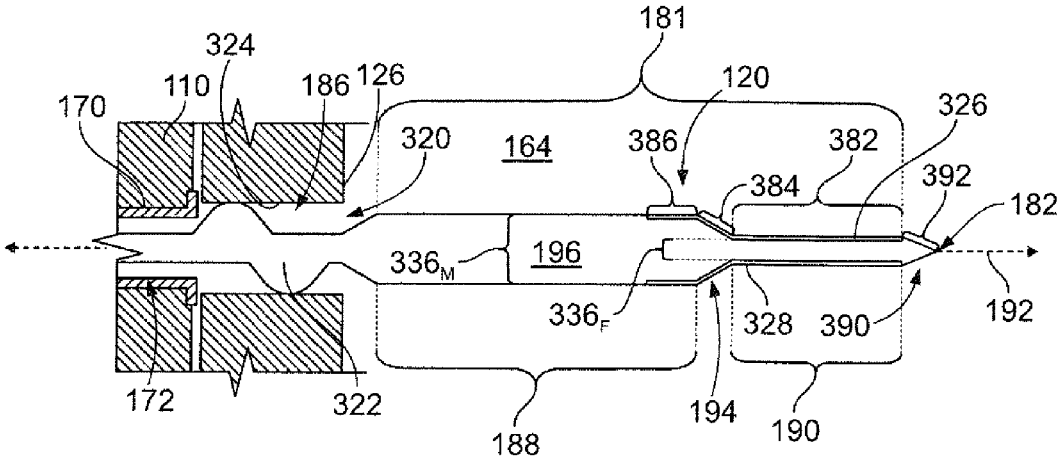
FIG. 5 is a side view of an exemplary header contact while in an operable position with respect to the header connector.

FIG. 5 illustrates a side view of an exemplary header contact 120 when secured to the mounting wall 126 of the second header connector 118 (FIG. 1) and the circuit board 110. Although the following is with respect to a single header contact 120 of the second header connector 118, it should be understood that other header contacts 120 of the second header connector 118 may engage the mounting wall 126 and the circuit board 110 in a similar or identical manner. The following description may also be applicable to the first header connector 116 (FIG. 1).

As shown, the mounting wall 126 includes a passage 320 that is configured to receive the corresponding header contact 120. The header contact 120 extends through the passage 320 of the mounting wall 126 and into a corresponding conductive via 170 of the circuit board 110. In FIG. 5, only a portion of the compliant pin 172 of the header contact 120 is shown within the conductive via 170. The compliant pin 172 may form an interference fit with the circuit board 110. The proximal base 186 of the header contact 120 includes projections 322 that are configured to engage an interior surface 324 of the mounting wall 126 that defines the passage 320. The projections 322 form an interference fit with the interior surface 324 such that the header contact 120 is held in a substantially fixed position with respect to the mounting wall 126. In an exemplary embodiment, the passage 320 has a cylindrical shape that extends linearly through the mounting wall 126. As such, the header contact 120 may be inserted into the passage 320 from either side of the mounting wall 126. In other embodiments, the passage 320 may have a non-linear shape. In such embodiments, the header contact 120 may be inserted into the passage 320 in only one direction.

As shown, the mating segment 188 of the header contact 120 projects from the mounting wall 126 into the housing cavity 164. As the header contact 120 extends away from the mounting wall 126, the header contact 120 transitions from the mating segment 188 to the forward segment 190. More specifically, the header contact 120 includes a ramp portion 194 that joins the mating segment 188 and the forward segment 190. The forward segment 190 extends between the distal end 182 and the ramp portion 194.

The elongated body 181 includes an exterior surface 196 that is configured to engage the contact fingers 302, 304 (FIG. 4) along first and second wipe tracks 326, 328, respectively. The first and second wipe tracks 326, 328 face in opposite directions and extend along the central axis 192. In FIG. 5, the first and second wipe tracks 326, 328 are indicated as bolded lines along the exterior surface 196 of the elongated body 181. The bolded lines indicate where the contact fingers 302, 304 slidably engage the exterior surface 196 and do not represent additional structure or an additional feature. Each of the first and second wipe tracks 326, 328 represents a path along the exterior surface 196 that the corresponding contact finger directly engages and wipes therealong during the mating operation. Each of the first and second wipe tracks 326, 328 extends from the forward segment 190, through the ramp portion 194, and to the mating segment 188. As described below, each of the first and second wipe tracks 326, 328 may have non-linear paths such that the corresponding contact finger is deflected by different amounts at different stages of the mating operation.

Figure 6:
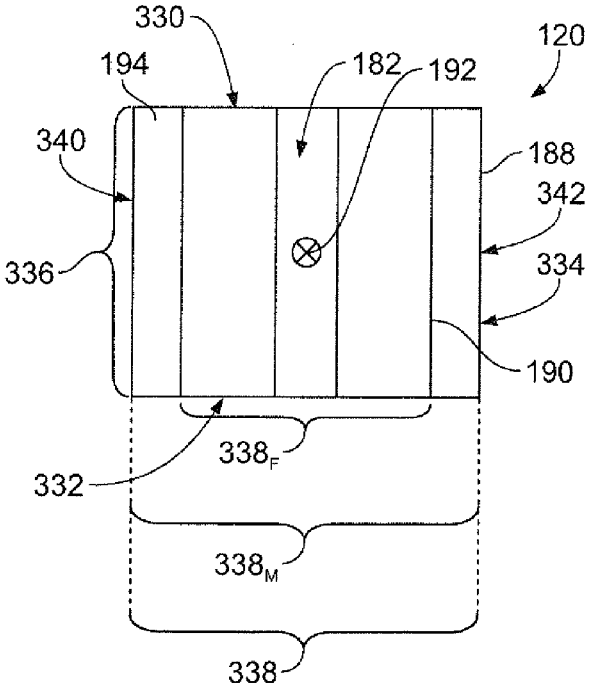
FIG. 6 is an end view of the header contact of FIG. 5.

FIG. 6 is an end view of the distal end 182 of the header contact 120 along the central axis 192. In an exemplary embodiment, the header contact 120 is stamped from sheet metal. As such, the header contact 120 may have first and second body sides 330, 332 that face in opposite directions and a stamped edge 334 that extends between the first and second body sides 330, 332. The stamped edge 334 extends entirely around the header contact 120 and may define a profile of the header contact 120. The stamped edge 334 forms side edge portions 340, 342 of the header contact 120. The side edge portions 340, 342 may include the first and second wipe tracks 326, 328, respectively, which are shown in FIG. 5.

As shown in FIG. 6, the header contact 120 has a substantially uniform thickness 336 that is measured between the first and second body sides 330, 332 and a varying width 338 that is measured between the side edge portions 340, 342. In other embodiments, the header contact 120 may have a varying thickness and a substantially uniform width. Also shown, the header contact 120 is substantially linear along the central axis 192. In other embodiments, the header contact 120 may be shaped or formed to extend in a non-linear manner.

After stamping the sheet metal, the unfinished header contact 120 may be treated to include designated coatings. By way of example only, the sheet metal may include a copper alloy. After stamping the header contact 120 from the sheet metal, a first coating (not shown) may be applied directly to the copper alloy base. A second coating (not shown) may be applied onto the first coating. The first and second coatings may be applied using, for example, an electroplating process. In an exemplary embodiment, the first coating includes nickel and the second coating includes gold. However, other conductive materials may be used to finish the header contact 120. The first coating may be, for example, about 1.5 to about 2.5 microns (or micrometers). The second coating may be, for example, about 0.5 to about 1.0 microns. In an exemplary embodiment, the header contact 120 may include a third coating that is applied to the second coating. The third coating may be, for example a pore blocker that is configured to prevent moisture from contacting the second coating.

Embodiments set forth herein include electrical contacts, such as the header contact 120, having a varying cross-sectional dimension that causes a change in the contour or path of the wipe tracks 326, 328 (FIG. 5). For example, in the illustrated embodiment, the header contact 120 includes the varying width 338. The width 338 is a cross-sectional dimension that is measured transverse to the central axis 192. However, in other embodiments, the varying cross-sectional dimension may be the thickness 336. Yet still in other embodiments, the varying cross-sectional dimension may be a diameter or other dimension that is taken transverse to the central axis 192.

For example, the mating segment 188 has a width $338_M$ and the forward segment 190 has a width $338_F$. The width $338_M$ of the mating segment 188 is greater than the width $338_F$ of the forward segment 190. For example, the width $338_M$ may be about 15% to 25% greater than the width $338_F$. The width 338 changes as the header contact 120 transitions along the ramp portion 194 between the forward segment 190 and the mating segment 188. More specifically, the width 338 increases as the header contact 120 transitions through the ramp portion 194 from the forward segment 190 to the mating segment 188. The ramp portion 194 is configured to deflect the contact fingers 302, 304 (FIG. 4) away from the central axis 192 during the mating operation as the contact fingers 302, 304 slide from the forward segment 190 toward the mating segment 188.

Figure 7:
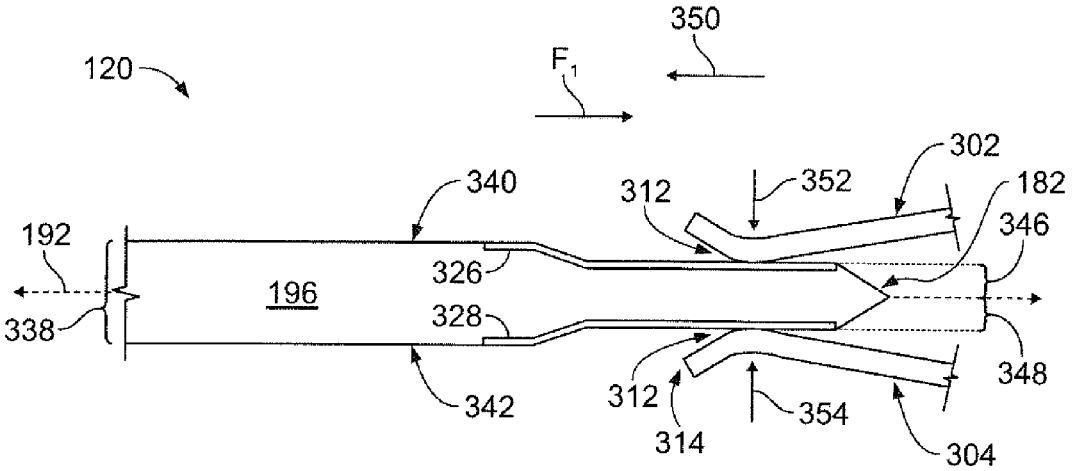
FIG. 7 is a side view of the header contact at a first stage of a mating operation.

FIG. 7 is a side view of an exemplary header contact 120 and contact fingers 302, 304 during a first stage of the mating operation between, for example, the first receptacle connector 132 (FIG. 1) and the first header connector 116 (FIG. 1). As shown, the mating interfaces 312 of the contact fingers 302, 304 engage the side edge portions 340, 342, respectively. However, depending on the orientation of the receptacle contact 142 (FIG. 4), the contact fingers 302, 304 may engage the side edge portions 342, 340, respectively. During the mating operation, the first receptacle connector 132 is aligned with the first header connector 116 and advanced in a mating direction 350 toward the first header connector 116. As shown in FIG. 7, the header contact 120 is received within the contact-receiving gap 314 between the mating interfaces 312 of the contact fingers 302, 304. In some embodiments, the distal end 182 engages the mating interfaces 312 to initially deflect each of the contact fingers 302, 304.

As set forth herein, embodiments may include electrical contacts, such as the header contacts 120, with varying cross-sectional dimensions that may reduce wear experienced by the electrical contacts and/or increase durability. For example, the varying width 338 may cause the contact fingers 302, 304 to have different deflected conditions during the mating operation. In FIG. 7, each of the contact fingers 302, 304 is in a first deflected condition. The mating interfaces 312 of the contact fingers 302, 304 directly engage the side edge portions 340, 342, respectively, of the header contact 120. The mating interfaces 312 are configured to wipe along the wipe tracks 326, 328 (represented by bolded lines), which extend along the respective side edge portions 340, 342.

In the first deflected conditions, the mating interfaces 312 of the contact fingers 302, 304 are positioned at respective elevations (or radial distances) 346, 348 away from the central axis 192. The contact finger 302 generates a normal force 352 toward the central axis 192 that presses the corresponding mating interface 312 into the side edge portion 340, and the contact finger 304 generates a normal force 354 that presses the corresponding mating interface 312 into the side edge portion 342. The normal forces 352, 354 are substantially perpendicular to the mating direction 350. In the illustrated embodiment, the normal forces 352, 354 are substantially equal in magnitude but opposite in direction. In other embodiments, the normal forces 352, 354 may have different magnitudes and/or directions that are not opposite each other.

When the mating interfaces 312 and the side edge portions 340, 342 are engaged as shown in FIG. 7, frictional forces (represented collectively as $F_1$) are generated between the mating interfaces 312 and the side edge portions 340, 342. The frictional forces $F_1$ are based, in part, on the normal forces 352, 354 and may resist movement of the contact fingers 302, 304 in the mating direction 350. In some embodiments, the frictional forces $F_1$ provide a tactile indication to an individual, such as a technician, that the mating operation is at the first stage.

Figure 8:
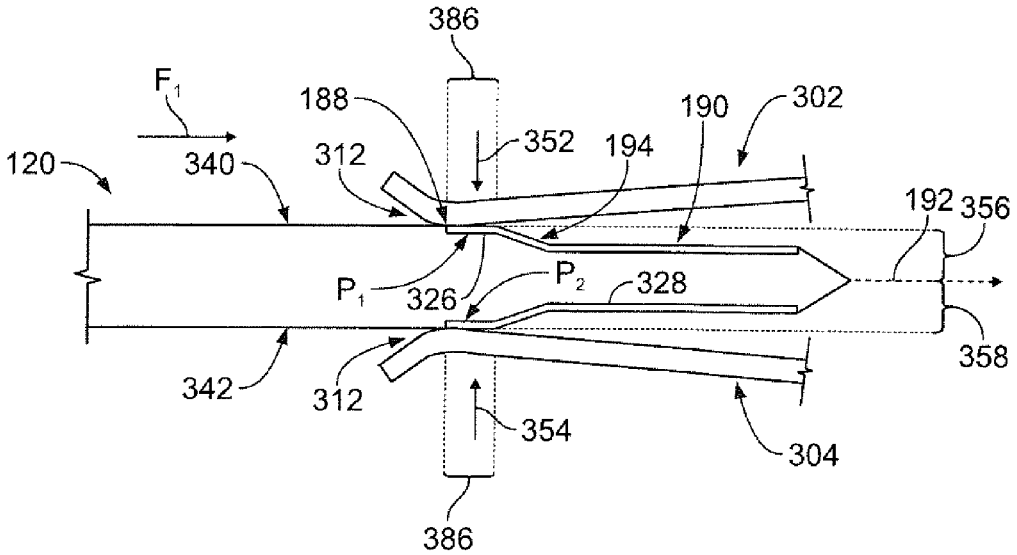
FIG. 8 is a side view of the header contact at a second stage of the mating operation.

FIG. 8 is a side view of the header contact 120 and the contact fingers 302, 304 during a second stage of the mating operation. As the contact fingers 302, 304 move from the first stage shown in FIG. 7 to the second stage shown in FIG. 8 along the respective wipe tracks 326, 328, the mating interfaces 312 of the contact fingers 302, 304 engage the ramp portion 194. The ramp portion 194 deflects the mating interfaces 312 further away from each other to corresponding second deflected conditions. The contact fingers 302, 304 are in the second deflected conditions in FIG. 8. The normal forces 352, 354 increase as the contact fingers 302, 304 wipe through the ramp portion 194, which may provide a tactile indication to the individual that the mating operation is transitioning from the first stage to the second stage. More specifically, the frictional forces $F_1$ may increase as the contact fingers 302, 304 wipe through the ramp portion 194. The change in magnitude of the frictional forces $F_1$ may be detected by the individual.

In the second deflected conditions, the mating interfaces 312 of the contact fingers 302, 304 are positioned at elevations (or radial distances) 356, 358, respectively, away from the central axis 192. The elevations 356, 358 are greater than the elevations 346, 348, respectively (shown in FIG. 7). In the second deflected conditions, the normal forces 352, 354 of the contact fingers 302, 304, respectively, press the corresponding mating interfaces 312 into the side edge portions 340, 342, respectively. The normal forces 352, 354 associated with the second deflected conditions are greater than the normal forces 352, 354 associated with the first deflected conditions. Accordingly, the contact fingers 302, 304 may generate a first normal force when in the first deflected condition and generate a second normal force when in the second deflected condition, wherein the second normal force is greater than the first normal force.

When the contact fingers 302, 304 are in the second deflected conditions, the frictional forces $F_1$ generated between the mating interfaces 312 and the side edge portions 340, 342 may impede movement in either direction along the central axis 192. The frictional forces $F_1$ when the contact fingers 302, 304 are engaged to the mating segment 188 may be greater than the frictional forces $F_1$ when the contact fingers 302, 304 are engaged to the forward segment 190. During operation of the header connector 116 (FIG. 1), the mating interfaces 302, 304 are directly engaged to the mating segment 188.

Returning to FIG. 5, the wipe tracks 326, 328 may extend a lead-in wiping distance 382 that corresponds to the forward segment 190, a ramp wiping distance 384 that corresponds to the ramp portion 194, and a mated wiping distance 386 that corresponds to the mating segment 188. As shown, the lead-in wiping distance 382 may be substantially greater than the ramp wiping distance 384 and/or the mated wiping distance 386. For example, the lead-in wiping distance 382 may be at least two times (2×) the ramp wiping distance 384 or the mated wiping distance 386. In some embodiments, the lead-in wiping distance 382 may be at least three times (3×) the ramp wiping distance 384 or the mated wiping distance 386, or, in particular embodiments, at least four times (4×) the ramp wiping distance 384 or the mated wiping distance 386. Also shown, the header contact 120 may include a tapered surface 390 that extends a distance 392 from the distal end 182 to the forward segment 190. The distance 392 may be significantly less than the lead-in wiping distance 382.

With respect to FIGS. 7 and 8, the wipe tracks 326, 328 may have non-linear paths that reduce a total mechanical wear experienced by the header contact 120 during a mating operation. For instance, the wipe tracks 326, 328 may be configured to reduce the normal forces 352, 354 applied by the contact fingers 302, 304, respectively, for a portion of the wiping. More specifically, as the mating interfaces 312 wipe along the forward segment 190 (FIG. 8), the mating interfaces 312 are pressed against the wipe tracks 326, 328 with the respective normal forces 352, 354. In some cases, the normal forces 352, 354 applied at the forward segment 190 may be substantially less than the normal forces typically experienced for known header contacts. For example, each of the normal forces 352, 354 may be less than a standard baseline normal force that is typically used to establish a sufficient electrical connection. In such embodiments, the mechanical wear along the forward segment 190 may be reduced. The reduced wear along the forward segment 190 may increase the durability and/or lifetime operability of the header contact 120.

In addition to the above, embodiments set forth herein may be configured to reduce or minimize the mechanical wear experienced along the mating segment 188. For example, the receptacle connector 132 and the header connector 116 may be fully mated immediately after the contact fingers 302, 304 are flexed to the second deflected conditions to reduce the mechanical wear. As shown in FIG. 8, the mating interfaces 312 of the contact fingers 302, 304 engage the mating segment 188 at contact points $P_1$ and $P_2$, respectively. Each of the contact points $P_1$, $P_2$ is located the mated wiping distance 386 away from the ramp portion 194. In some embodiments, the first header connector 116 (FIG. 1) and the first receptacle connector 132 (FIG. 1) are configured to reduce or minimize the mated wiping distance 386 such that the contact points $P_1$, $P_2$ are proximate to the ramp portion 194. For example, various components of first header connector 116 and/or the first receptacle connector 132 may be shaped and/or dimensioned to locate the contact points $P_1$, $P_2$ proximate to the ramp portion 194. Non-limiting examples of such components include the front housing 138 (FIG. 1), the connector housing 116 (FIG. 1), the header contact 120, and/or the receptacle contact 142 (FIG. 3).

It is understood that tolerances during the manufacture and assembly of the communication system 100 (FIG. 1) may render it difficult to locate each of the mating interfaces 312 at a contact point that is both along the mating segment 188 and immediately adjacent to the corresponding ramp portion 194. For instance, the various tolerances during manufacture and assembly may effectively result in some mating interfaces 312 being immediately adjacent to the ramp portion 194 and other mating interfaces 312 being located a distance away from the ramp portion 194. Accordingly, the first header connector 116 and the first receptacle connector 132 may be configured so that the mated wiping distance 386 is a minimal wiping distance in which all (or nearly all) of the receptacle contacts 142 and corresponding header contacts 120 are engaged with a sufficient electrical connection (e.g., sufficient normal forces 352, 354). The minimal wiping distance may be referred to as the nominal wiping distance. For embodiments where the mated wiping distance 386 is the nominal wiping distance, the header contacts 120 may experience less mechanical wear than known header contacts while also obtaining a desired electrical performance. In alternative embodiments, the mated wiping distance 386 may be larger than a nominal wiping distance. For example, the mated wiping distance 386 may be substantially equal to the lead-in distance 382 (FIG. 5).

Figure 9:
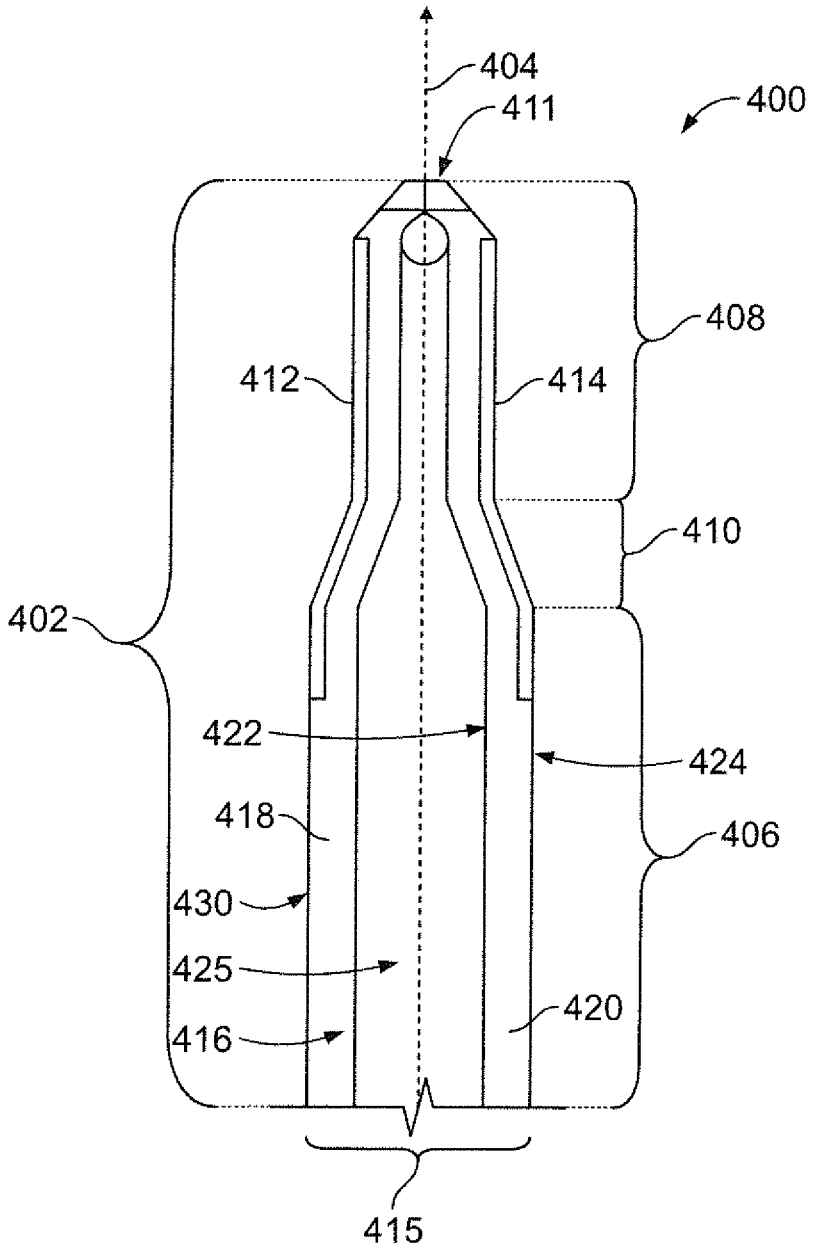
FIG. 9 is a side view of a header contact formed in accordance with an embodiment.

FIG. 9 is a side view of a portion of an electrical contact 400 formed in accordance with an embodiment. The electrical contact 400 may be used with, for example, the header connector 116 (FIG. 1) or the header connector 118 (FIG. 1) and may have similar features as the header contact 120 (FIG. 1). The electrical contact 400 includes an elongated body 402 that extends along a central axis 404 of the electrical contact 400. The electrical contact 400 includes a plurality of axial elements or portions that are shaped differently with respect to one another. For example, the electrical contact 400 includes a mating segment 406, a forward segment 408, and a ramp portion 410 that joins the mating segment 406 and the forward segment 408. The forward segment 408 includes a distal end 411 of the elongated body 402.

Similar to the header contact 120 (FIG. 1), the electrical contact 400 may be stamped from sheet metal and treated with designated coatings. Unlike the header contact 120, however, the sheet metal may be shaped after stamping. For example, the electrical contact 400 includes a stamped edge 416 and opposite body sides 422, 424. The stamped edge 416 extends between the body sides 422, 424. The body sides 422, 424 are portions of opposite side surfaces of the sheet metal prior to stamping. After stamping, the sheet metal is shaped such that the electrical contact 400 is U-shaped. For example, as shown in FIG. 9, the stamped edge 416 has a first edge portion 418 and a second edge portion 420. The first and second edge portions 418, 420 extend generally parallel and proximate to each other along the central axis 404 to the distal end 411. When the elongated body 402 is U-shaped, the body side 424 defines a channel 425. The central axis 404 extends generally through a center of the channel 425, and the first and second edge portions 418, 410 define an opening to the channel 425.

When U-shaped as shown in FIG. 9, the body side 424 forms an exterior surface 430 of the electrical contact 400. The exterior surface 430 includes first and second wipe tracks 412, 414 that are configured to directly engage contact fingers (not shown) of a receptacle contact (not shown). The wipe tracks 412, 414 are indicated with bolded lines and extend generally along the central axis 404 through the forward segment 408, the ramp portion 410, and a portion of the mating segment 406.

Similar to the header contact 120 (FIG. 1), the electrical contact 400 has a varying width 415 along the elongated body 402 that is measured between the wipe tracks 412, 414 transverse to the central axis 404. The width 415 may have a different value for each of the forward segment 408, the ramp portion 410, and the mating segment 406. For example, the forward segment 408, the ramp portion 410, and the mating segment 406 may be configured to operate in a similar manner as the forward segment 190 (FIG. 2), the ramp portion 194 (FIG. 5), and the mating segment 188 (FIG. 2), respectively, described herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing configured to engage a mating connector during a mating operation; and a contact array including electrical contacts coupled to the connector housing, each of the electrical contacts including an elongated body that extends along a central axis and has an exterior surface that is configured to engage a contact finger of the mating connector along a wipe track, the wipe track extending along the central axis and having an elevation relative to the central axis;

wherein each of the elongated bodies includes a forward segment, a mating segment, and a ramp portion that extends between and joins the forward and mating segments, the elevation of the wipe track along the mating segment being greater than the elevation of the wipe track along the forward segment, the elevation of the wipe track along the ramp portion increasing as the wipe track extends from the forward segment to the mating segment such that the ramp portion deflects the contact finger from a first deflected condition to a greater second deflected condition during the mating operation, wherein the electrical contacts each include a compliant pin that is configured to directly engage a conductive via of a circuit board.

2. The electrical connector of claim 1, wherein the wipe track extends parallel to the central axis along the forward segment for a designated lead-in wiping distance.

3. The electrical connector of claim 1, wherein the elevation of the wipe track increases in a substantially linear manner through the ramp portion.

4. The electrical connector of claim 1, wherein the connector housing includes a mounting wall and the electrical contacts each include a proximal base that directly engages the mounting wall, the mating segment extending away from the mounting wall toward the forward segment.

5. The electrical connector of claim 1, wherein the elongated bodies each include opposite body sides and a stamped edge extending between and joining the body sides, the stamped edge including the wipe track.

6. The electrical connector of claim 1, wherein the elongated bodies each include opposite body sides and a stamped edge extending between and joining the body sides, at least one of the body sides including the wipe track.

7. The electrical connector of claim 1, wherein the wipe track is a first wipe track and the exterior surface includes a second wipe track that is opposite the first wipe track, the second wipe track configured to engage another contact finger.

8. The electrical connector of claim 1, wherein the electrical contacts are arranged in signal pairs within the contact array and the contact array includes ground shields that are configured to electrically shield the signal pairs from one another.

9. A communication system comprising:

a receptacle connector comprising a plurality of receptacle contacts; and a header connector comprising a plurality of header contacts that are configured to engage corresponding receptacle contacts of the receptacle connector, each of the header contacts having an elongated body that extends along a central axis, each of the elongated bodies having a wipe track along an exterior surface of the corresponding elongated body that extends along the central axis;

wherein the receptacle contacts are configured to directly engage the corresponding header contacts along the corresponding wipe tracks during a mating operation between the receptacle and header connectors, the wipe tracks having non-linear paths such that the corresponding receptacle contacts flex from first deflected conditions to second deflected conditions during the mating operation, each of the receptacle contacts being in the second deflected condition when the receptacle and header connectors are fully mated, the receptacle contacts each applying first and second normal forces against the corresponding header contact when in the first and second deflected conditions, respectively, the second normal force being greater than the first normal force.

10. The communication system of claim 9, wherein the receptacle contacts are in the first deflected conditions for a corresponding designated lead-in wiping distance.

11. The communication system of claim 9, wherein the receptacle and header connectors are fully mated immediately after the receptacle contacts are flexed to the second deflected conditions.

12. The communication system of claim 9, wherein the receptacle contacts each include a pair of contact fingers that define a contact-receiving gap therebetween, the contact fingers configured to engage the corresponding header contact as the corresponding header contact is received within the contact-receiving gap.

13. The communication system of claim 9, wherein the header contacts are arranged in signal pairs and the header connector includes ground shields that are configured to electrically separate the signal pairs.

14. The communication system of claim 9, wherein the elongated bodies each include opposite body sides and a stamped edge extending between and joining the opposite body sides, the stamped edge including the wipe track.

15. The communication system of claim 9, wherein the elongated bodies each include opposite body sides and a stamped edge extending between and joining the body sides, at least one of the body sides including the wipe track.

16. The communication system of claim 9, wherein the header contacts each include a compliant pin that is configured to directly engage a conductive via of a circuit board.

17. An electrical contact comprising:

an elongated body extending along a central axis and having an exterior surface that is configured to engage a contact finger along a wipe track, the wipe track extending along the central axis and having an elevation relative to the central axis;

wherein the elongated body includes a forward segment, a mating segment, and a ramp portion that extends between and joins the forward and mating segments, the elevation of the wipe track along the mating segment being greater than the elevation of the wipe track along the forward segment, the elevation of the wipe track along the ramp portion increasing as the wipe track extends from the forward segment to the mating segment such that the ramp portion deflects the contact finger from a first deflected condition to a greater second deflected condition as the contact finger slides along the exterior surface in a mating direction that is parallel to the central axis, wherein the electrical contact includes a compliant pin that is configured to directly engage a conductive via of a circuit board.

18. The electrical contact of claim 17, wherein the wipe track extends parallel to the central axis along the forward segment for a designated lead-in wiping distance.

19. The electrical contact of claim 17, wherein the elevation of the wipe track along the ramp portion increases in a substantially linear manner.

* * * * *